US006636132B1

(12) United States Patent
Kim et al.

(10) Patent No.: US 6,636,132 B1
(45) Date of Patent: Oct. 21, 2003

(54) DIELECTRIC FILTER

(75) Inventors: Chul Ho Kim, Yongin-si (KR); Jin Duk Kim, Suwon-si (KR); Sang Jun Park, Suwon-si (KR)

(73) Assignee: Partron Co., Ltd., Kyungki-do (KR)

( * ) Notice: Subject to any disclaimer, the term of this patent is extended or adjusted under 35 U.S.C. 154(b) by 0 days.

(21) Appl. No.: 09/213,707

(22) Filed: Dec. 17, 1998

Related U.S. Application Data

(60) Provisional application No. 60/106,371, filed on Oct. 30, 1998.

(30) Foreign Application Priority Data

Jul. 8, 1998 (KR) ..... 98-27437
Aug. 19, 1998 (KR) ..... 98-33567

(51) Int. Cl.[7] ..... H01P 1/20; H01P 7/04

(52) U.S. Cl. ..... 333/206; 333/207; 333/222; 333/223

(58) Field of Search ..... 333/202, 206, 333/222, 207, 223

(56) References Cited

U.S. PATENT DOCUMENTS 4,716,391 A 12/1987 Moutrie et al.
4,740,765 A 4/1988 Ishikawa et al.
4,742,562 A 5/1988 Kommrusch
4,823,098 A * 4/1989 DeMuro et al. ..... 333/206
4,879,533 A 11/1989 de Muro et al.
4,896,124 A * 1/1990 Schwent ..... 333/206
5,004,992 A 4/1991 Grieco et al.

FOREIGN PATENT DOCUMENTS

| | | | |
|---|---|---|---|
| EP | 0 442 418 | | 2/1991 |
| EP | 0552761 | A1 * | 3/1994 |
| EP | 0595623 | A1 * | 5/1994 |
| EP | 0 757 401 | | 11/1997 |
| EP | 0 837 519 | | 4/1998 |
| JP | 406069702 | * | 3/1994 |

* cited by examiner

*Primary Examiner*—Robert Pascal
*Assistant Examiner*—Patricia T. Nguyen
(74) *Attorney, Agent, or Firm*—Renner, Otto, Boisselle & Sklar, LLP

(57) ABSTRACT

A dielectric filter stopping a frequency signal at a lower frequency band than a pass band as a reference band with a higher attenuation ratio to perform adjustment of the attenuation ratio even the lower frequency area. The dielectric filter comprises a predetermined conductive pattern on the front surface on a dielectric block in which a plurality of resonant holes are provided, the dielectric block including back and side surfaces covered with a conductive material, each resonant hole being covered with the conductive material in the internal surface, the predetermined conductive pattern being separated at a predetermined distance from the end portions of the resonant holes, whereby the predetermined conductive pattern forms a coupling capacitance between the adjacent resonators and a cross coupling capacitance between the resonators not adjacent to control an electromagnetic coupling over the whole dielectric filter.

18 Claims, 13 Drawing Sheets

DIELECTRIC FILTER

This application claims benefit of Provisional Application 60/106,371 filed Oct. 30, 1998.

FIELD OF THE INVENTION

The present invention relates to a dielectric filter, and more particularly, to an integrated type dielectric filter which can stop a frequency signal at a lower frequency area than a pass band as a reference band with a higher attenuation ratio, thus to perform adjustment of the attenuation ratio even the lower frequency area in a simple manner.

BACKGROUND OF THE INVENTION

Generally, a dielectric filter has a plurality of dielectric blocks which are connected with each other, each dielectric block including a coaxial resonator therein, thereby obtaining a desired pass band characteristic, and an integrated type dielectric filter as an improved filter in a constructional respect has a single dielectric block having a plurality of coaxial resonators therein.

The integrated type dielectric filter used as a band passing filter is adapted for use in obtaining only a frequency signal of a desired channel band in a mobile communication equipment such as, for example, a car telephone, a portable telephone and the like which utilizes a high frequency band as a communication band. By this reason, the integrated type dielectric filter requires a small size, a light weight, and a high degree of impact resistance and also should need a band passing characteristic of about 20–30 MHz.

FIGS. 1 to 3 show first to third conventional integrated type dielectric filters, respectively. Firstly, the conventional integrated type dielectric filter as shown in FIG. 1 has a coupling hole 9 disposed between two resonant holes 7 and 8, to thereby adjust mutual inductance and mutual capacitance. In this case, a degree of coupling is dependent upon the size, length and position of the coupling hole 9. However, addition of the coupling hole 9 causes the molding of the dielectric filter to be difficult as well as a mechanical strength thereof to be deteriorated, such that there is a problem in that the conventional integrated type dielectric filter is not satisfied with the requirements of the existing mobile communication equipment. Secondly, the conventional integrated type dielectric filter as shown in FIG. 2A includes two resonant holes 7 and 8 which each have an inconstant inside diameter, that is, have the inside diameter being varied at a specific portion thereof, as shown in FIG. 2B, to thereby achieve the coupling of the resonant holes by a characteristic impedance difference caused due to the difference of the inside diameter of the resonant hole. When compared with the dielectric filter as shown in FIG. 1, the integrated type dielectric filter of FIG. 2A has an improved band passing characteristic, but there still remains a problem in that since the inside diameter of the small resonant hole is not constant, the manufacturing process becomes complicated and an uniform molding state can not be accomplished. Finally, the conventional integrated type dielectric filter as shown in FIG. 3A does not have any opening surface when compared with the above conventional dielectric filters and has a side surface of a dielectric block 1 on which a conductive material is covered to thereby form an electrode, and specific portions 17 and 18 within the interior of the resonant holes 7 and 8 whose electrodes are eliminated, as shown in FIG. 3B, thus to achieve the coupling state between the resonators. In the conventional dielectric filter as shown in FIG. 3A, however, there is a problem in that it is difficult that the electrodes placed at an arbitrary position of the internal surfaces of the small resonant holes 7 and 8 are accurately removed.

Moreover, as recently the interval between communication channels is gradually shortened, the dielectric filter should have a high attenuation characteristic and particularly, in the case where the dielectric filter is quite adjacent to a transmitting channel and/or a receiving channel, it should need a higher attenuation ratio at a specific frequency band.

For instance, in the case where the dielectric filter has the transmitting channel as a pass band, it should require a higher attenuation ratio at a lower frequency band than a pass band as a reference band, not to receive a signal of the receiving channel which is adjacent to the low frequency band. As discussed above, however, it is evident that the first to third conventional integrated type dielectric filters can not provide such the higher attenuation ratio.

SUMMARY OF THE INVENTION

Accordingly, an object of the present invention is to provide an integrated type dielectric filter which can stop a frequency signal at a lower frequency band than a pass band as a reference band with a higher attenuation ratio, thus to perform adjustment of the attenuation ratio even the lower frequency area in a simple manner.

Another object of the present invention is to provide an integrated type dielectric filter which can stop a signal of a desired frequency band at lower frequency band than a pass band as a reference band with a higher attenuation ratio, thus to perform adjustment of the attenuation ratio even the lower frequency area.

According to an aspect of the present invention, there is provided an integrated type dielectric filter including: a dielectric block comprising first and second surfaces facing to each other and a side surface disposed between the first and second surfaces, the second and side surfaces being substantially covered with a conductive material; a plurality of resonant holes disposed substantially parallel to penetrate the first and second surfaces of the dielectric block and being substantially covered with the conductive material on the internal surfaces thereof, each of the plurality of resonant holes forming a resonator; input/output terminals each comprising an electrode area isolated from the conductive material of the side surface of the dielectric block and for forming an electromagnetic coupling with the plurality of resonant holes; and at least one conductive pattern disposed at a predetermined distance from the end portion of each of said plurality of resonant holes on said first surface of said dielectric block, for forming the electromagnetic coupling between the adjacent resonators.

Preferably, the conductive pattern is disposed at a predetermined distance from the end portion of each of the plurality of resonant holes on the first surface of the dielectric block, along with the arranged direction of the plurality of resonant holes, for forming a coupling capacitance between the adjacent resonators and for forming a cross coupling capacitance between the resonators not adjacent. Accordingly, the dielectric filter can form a pass band having a low frequency area as the coupling inductance between the resonators is increased by the formation of the conductive pattern.

According to another aspect of the present invention, there is provided an integrated type dielectric filter including: a dielectric block comprising first and second surfaces facing to each other and a side surface disposed between the first and second surfaces, the second and side surfaces being substantially covered with a conductive material; a plurality of resonant holes disposed substantially parallel to penetrate the first and second surfaces of the dielectric block and being substantially covered with the conductive material on the internal surfaces thereof, each of the plurality of resonant holes forming a resonator; input/output terminals each comprising an electrode area isolated from the conductive material of the side surface of the dielectric block and for forming an electromagnetic coupling with the plurality of resonant holes; and a resonant frequency adjusting conductive pattern disposed to be extended from the side surface of the dielectric block toward the end portions of the resonant holes of the first surface on the dielectric block, for adjusting a resonant frequency of each of the resonators.

BRIEF DESCRIPTION OF THE DRAWINGS

Other objects and aspects of the invention will become apparent from the following description of embodiments with reference to the accompanying drawing in which.

DETAILED DESCRIPTION OF THE PREFERRED EMBODIMENT

Hereinafter, an explanation on the construction and operational effect of an integrated type duplexer dielectric filter according to the preferred embodiments of the present invention will be discussed with reference to the attached drawings.

Figure 1:
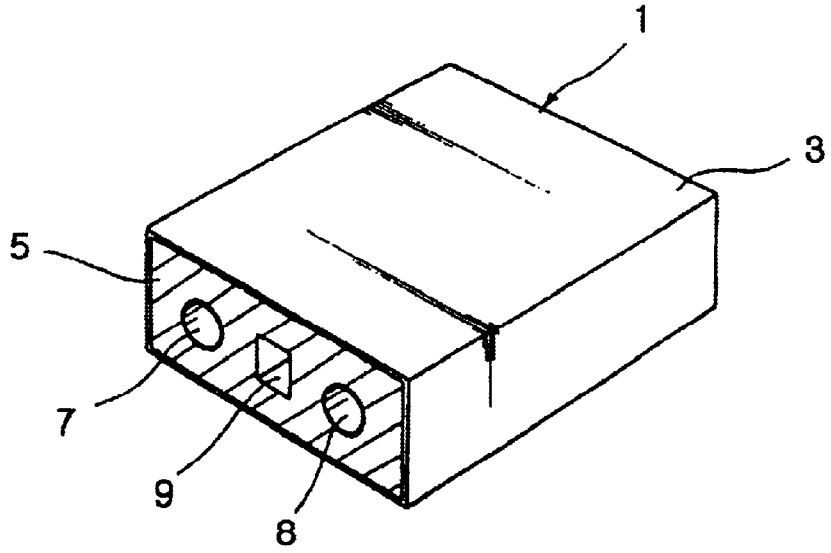
FIG. 1 PRIOR ART
FIG. 1 is a perspective view of a conventional integrated type dielectric filter.
Figure 2A:
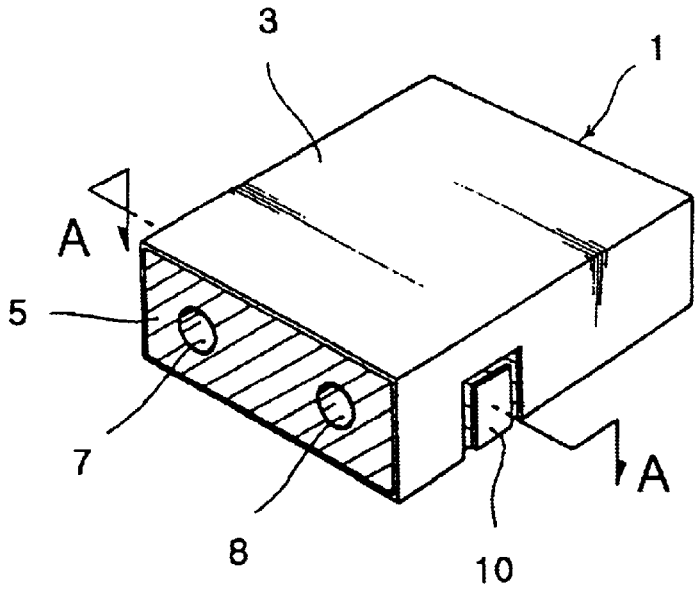
FIG. 2A PRIOR ART
FIG. 2A is a perspective view of other conventional integrated type dielectric filter.
Figure 2B:
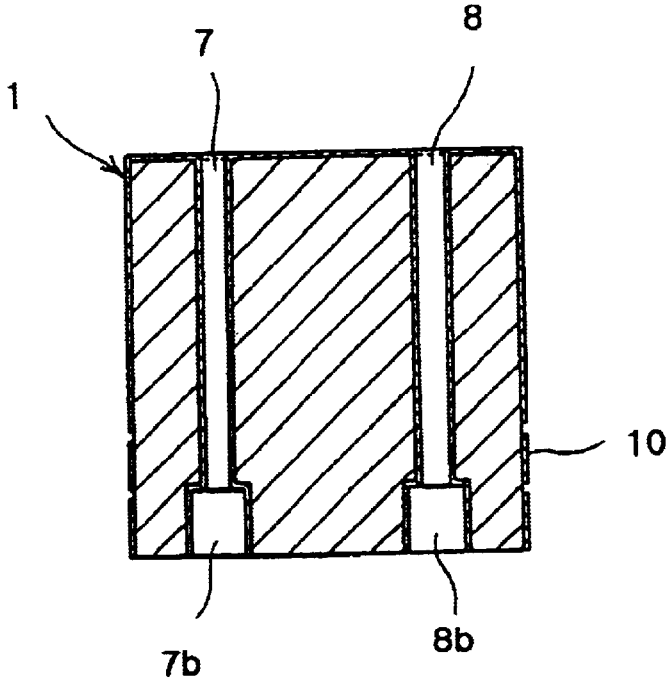
FIG. 2B PRIOR ART
FIG. 2B is a sectional view taken along the line A–A' of FIG. 2.
Figure 3A:
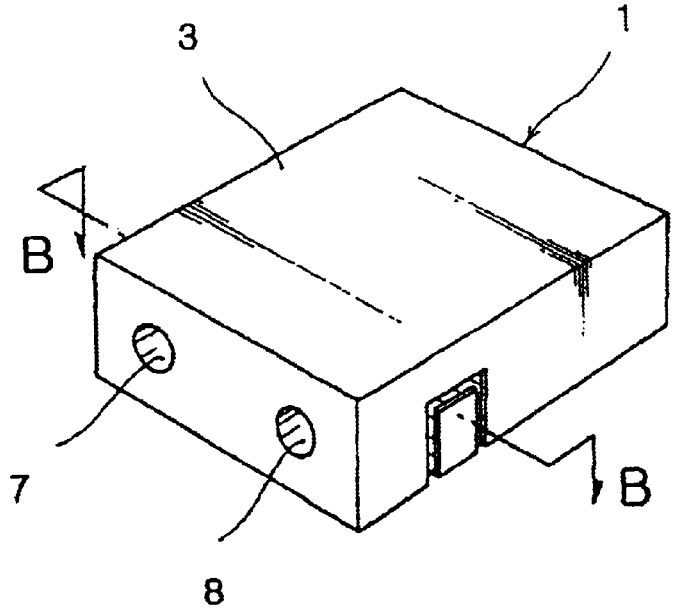
FIG. 3A PRIOR ART
FIG. 3A is a perspective view of another conventional integrated type dielectric filter.
Figure 3B:
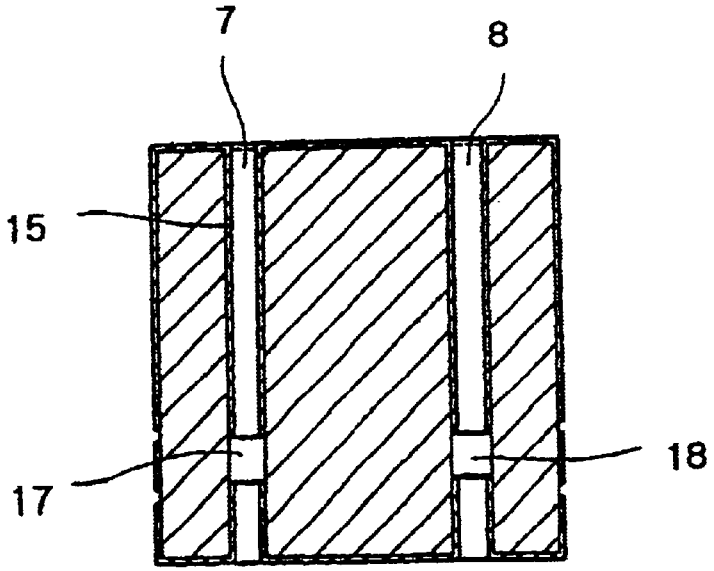
FIG. 3B PRIOR ART
FIG. 3B is a sectional view taken along the line B–B' of FIG. 3.
Figure 4A:
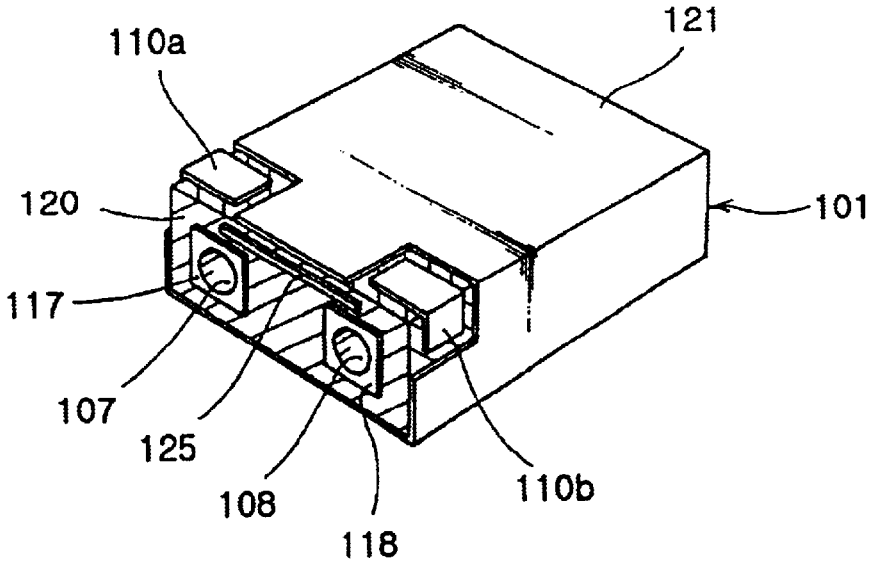
FIGS. 4A to 4F are perspective views illustrating the integrated type dielectric filter according to preferred embodiment of a first embodiment of the present invention.

FIGS. 4A to 4F are perspective views of first to sixth integrated type dielectric filters embodied according to a preferred embodiment of the present invention, each dielectric filter having the same dielectric block structure as each other but having predetermined conductive patterns which are formed on the front surface of the dielectric block and are different in shape from each other. As shown in FIG. 4A, the integrated type duplexer dielectric filter includes a dielectric block 101 having first and second surfaces 120 and 121 facing to each other and a side surface disposed between the first and second surfaces 120 and 121. A conductive material is covered on the second surface 121 and the side surface to form a ground electrode. Also, the dielectric block 101 has a plurality of resonant holes 107 and 108 formed at a predetermined distance from one another on the interior thereof to penetrate the first and second surfaces 120 and 121 in a substantially parallel manner. The dielectric block 101 includes an internal electrode on the internal surfaces of the resonant holes 107 and 108 to form the resonator. On the other hand, an open area on which the conductive material is not covered is formed on the first surface 111 of the dielectric block 110. Input/output pads 110*a* and 110*b*, which are formed on the side surface of the dielectric block 101, are short-circuited with the ground electrode. The input/output pads 110*a* and 110*b* are insulated from the ground electrode, in the state where a part of their ground electrodes is removed, and are disposed to be extended over the one portion of the side surface and the adjacent surface to the side surface. In other words, since the open area on which the conductive material is not covered is occupied between the input/output pads 110*a* and 110*b* and the ground electrode, the short-circuit therebetween is formed. At this time, the open area is extended to the first surface 120 as an opened surface, as shown in FIG. 4A. However, the input/output pads 110*a* and 110*b* may be extended to the opened surface of the first surface 120, but the conductive material may be covered on the space between the open resion of the input/output pads 110*a* and 110*b* and the first surface 120, as shown in FIGS. 4B to 4F as will be hereinafter discussed.

The dielectric block 101 includes the first surface 120 as an opening surface on which the conductive material is not covered and includes predetermined size of first conductive patterns 117 and 118 which are formed on the surroundings of the resonant holes 107 and 108 and are each connected with the conductive materials on th internal surface of the resonant holes 107 and 108. The first conductive patterns 117 and 118 each apply a loading capacitance to the resonators and at the same time form a coupling capacitance between the adjacent resonators.

Furthermore, the dielectric block 101 includes a second conductive pattern 125 on the upper portion of the resonant holes 107 and 108, that is, between the resonant holes 107 and 108 and the side surface thereof along the arrangement direction of the resonant holes 107 and 108. The second conductive pattern 125 is disposed to be separated at a predetermined distance from the first conductive patterns 117 and 118 and applies the coupling capacitance between the adjacent resonators.

Figure 4B:
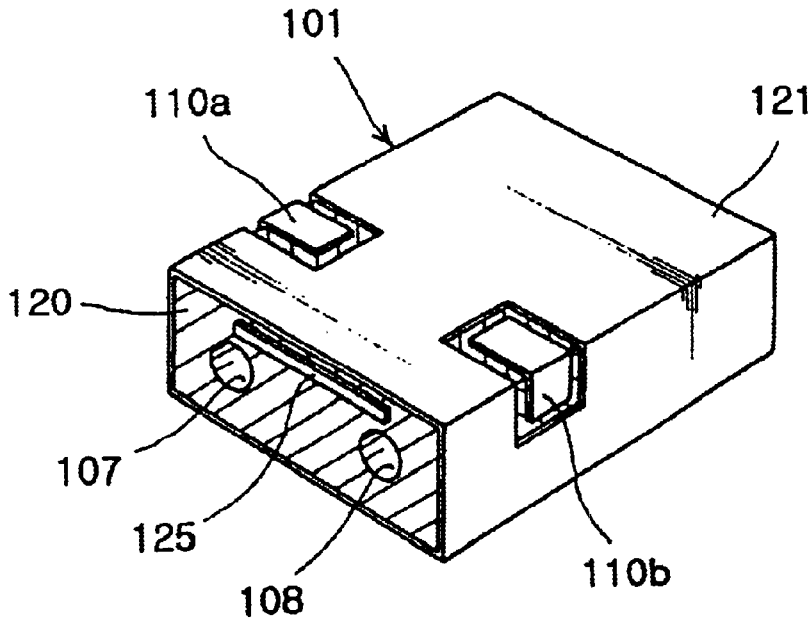

As mentioned above, since the dielectric filter as shown in FIG. 4B has the same dielectric block structure as shown in FIG. 4A and has the different conductive pattern structures on the front surface thereof from that as shown in FIG. 4A, a detailed explanation of the structure of the conductive patterns formed on the front surface 120 of the dielectric block 101 will be discussed, while avoiding an explanation of the structure of the dielectric block 101. At this time, the shape of the input/output pads 110*a* and 110*b* of FIG. 4B is different from that of FIG. 4A, but theses pads 110*a* and 110*b* have the substantially indentical function of the pads of FIG. 4A. Further, the pads shown in FIGS. 4C to 4F are also identical with the pads shown in FIG. 4B.

As shown in FIG. 4B, the dielectric block 101 includes a strip line shaped second conductive pattern 125 which is separated at a predetermined distance from the end portions of the resonant holes 107 and 108 on the first surface along the arrangement direction of the resonant holes 107 and 108 and applies the coupling capacitance between the adjacent resonators. However, the first conductive patterns 117 and 118 as shown in FIG. 4A which are formed on the surroundings of the resonant holes 107 and 108 do not exist in the embodiment of FIG. 4B. At this time, the second conductive pattern 125 may be disposed on the upper portion or lower portion of the resonant holes 107 and 108 or on both the upper and lower portions thereof.

Figure 4C:
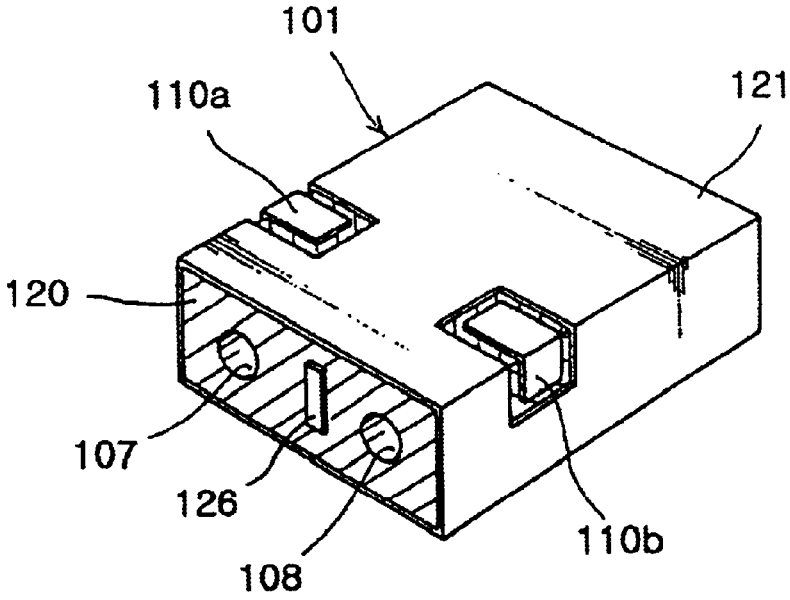

In the embodiment of FIG. 4C, the dielectric block 101 includes a strip line shaped third conductive pattern 126 which is formed between the resonant holes 107 and 108 on the first surface 120 and applies the coupling capacitance between the adjacent resonators. At this time, althoug the third conductive pattern 126 is disposed to be separated at a predetermined distance from the conductive material covered on the side surface of the dielectric block 101, this pattern 126 can be connected with the conductive materials on the side surface. Since the coupling capacitance is formed between the internal electrode of the resonant hole 107 and the third conductive pattern 126 and between the internal electrode of the resonant hole 108 and the third conductive pattern 126, respectively, the dielectric filter can increase the coupling capacitance all over.

Figure 4D:
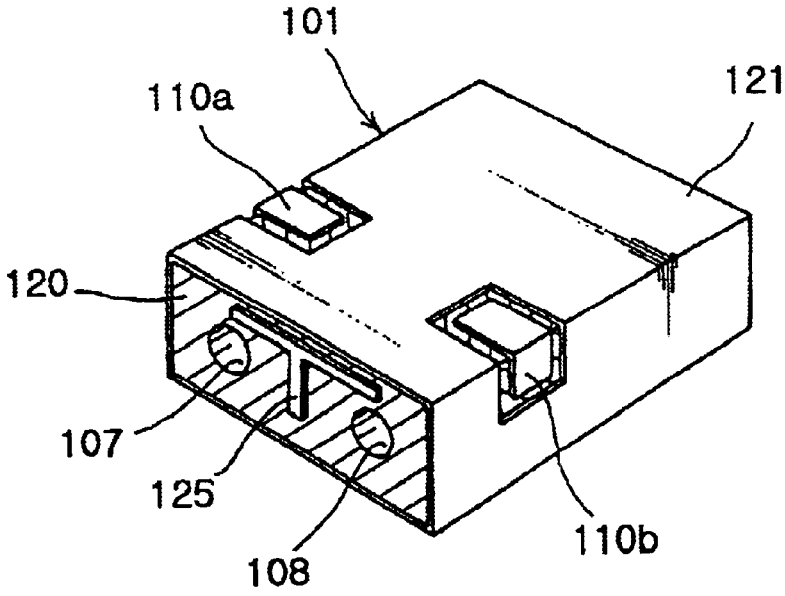

The embodiment of FIG. 4D is embodied by the mixture of the embodiments of FIGS. 4B and 4C. In other words, the dielectric block 101 includes the strip line shaped second conductive pattern 125 which is disposed to be separated at a predetermined distance from the end portions of the resonant holes 107 and 108 on the first surface 120 along the arrangement direction of the resonant holes 107 and 108 and has predetermined width and length on at least one portion of the upper and lower portions of the resonant holes 107 and 108, for applying the coupling capacitance between the adjacent resonators. Further, the dielectric block 101 includes the strip line shaped third conductive pattern 126 which is formed between the resonant holes 107 and 108 on the first surface 120 and applies the coupling capacitance between the adjacent resonators. The second conductive pattern 125 is formed as an integrated body with the third conductive pattern 126, as shown in FIG. 4D. However, this second conductive pattern 125 can be separated from the third conductive pattern 126.

Figure 4E:
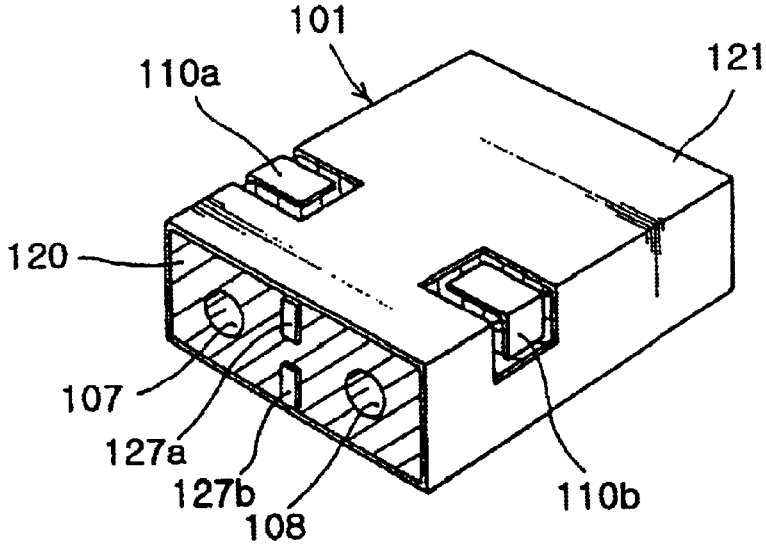

In the embodiment of FIG. 4E, the dielectric block 101 includes a pair of fourth conductive patterns 127*a* and 127*b* of the strip line shape which are formed between the resonant holes 107 and 108 on the first surface 120 and are disposed to be separated by a predetermined interval from each other. In more detail, the one fourth conductive pattern 127*a* is extended from the conductive material of the side surface of the dielectric block 101 toward the space between the resonant holes 107 and 108, and the other fourth conductive pattern 127*b* is extended from the opposite side of the side surface of the dielectric block 101 toward the space between the resonant holes 107 and 108, whereby the fourth conductive patterns 127*a* and 127*b* maintain the predetermined interval therebetween.

Figure 4F:
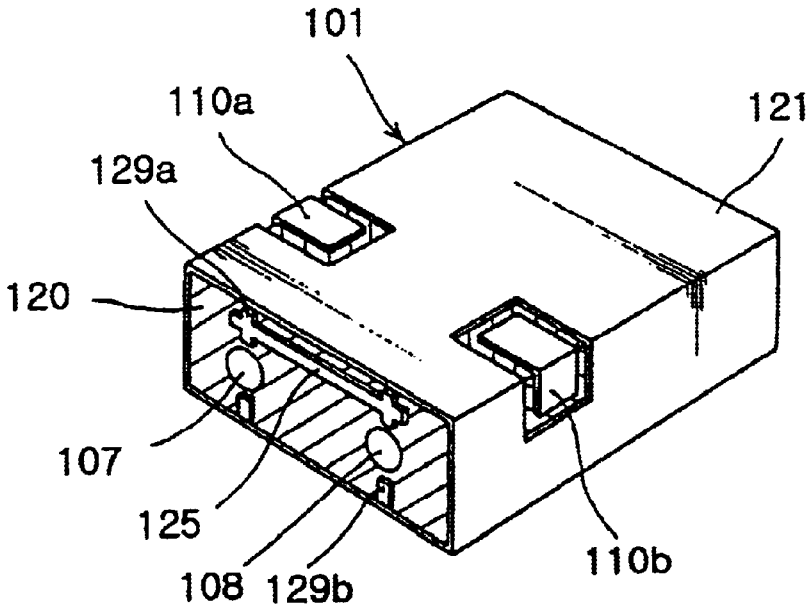

The embodiment of FIG. 4F has the different shape and structure from the embodiments of FIGS. 4A to 4E as above-mentioned. The dielectric block 101 of FIG. 4F includes the strip line shaped second conductive pattern 125 which is disposed on the upper portion of the resonant holes 107 and 108 on the first surface 120 thereof along the arrangement direction of the resonant holes 107 and 108 and applies the coupling capacitance between the adjacent resonators and fifth conductive patterns 129*a* and 129*b* which are each disposed at the left and right side of the length direction of the second conductive pattern 125 and on the lower portion of the resonant holes 107 and 108. The fifth conductive pattern 129*a*, which is disposed along the length direction of the second conductive pattern 125, is formed to be integrated with the second conductive pattern 125, and the other fifth conductive pattern 129*b*, which is disposed on the lower portion of the resonant holes 107 and 108, is connected to the conductive material of the side surface of the dielectric block 101.

The fifth conductive patterns 129*a* and 129*b* are used for adjusting the resonant frequency of each resonator. In the same manner as the first to forth conductive patterns, the resonant frequency adjusting fifth conductive patterns 129*a* and 129*b* are formed to have the predetermined size on the first surface 120 of the dielectric block 101 and serve to finely adjust the resonant frequency of each resonator.

As shown, the fifth conductive pattern 129*a* which is disposed at the left and right portions of the length direction of the second conductive pattern 125 is formed to be integrated with the second conductive pattern 125. However, the fifth conductive pattern 129*a* can be separated from the second conductive pattern 125 in a predetermined distance. Meanwhile, the fifth conductive pattern 129*b* which is disposed on the lower portion of the resonant holes 107 and 108 may be formed to be short-circuited to the conductive material of the side surface of the dielectric block 101.

Figure 5:
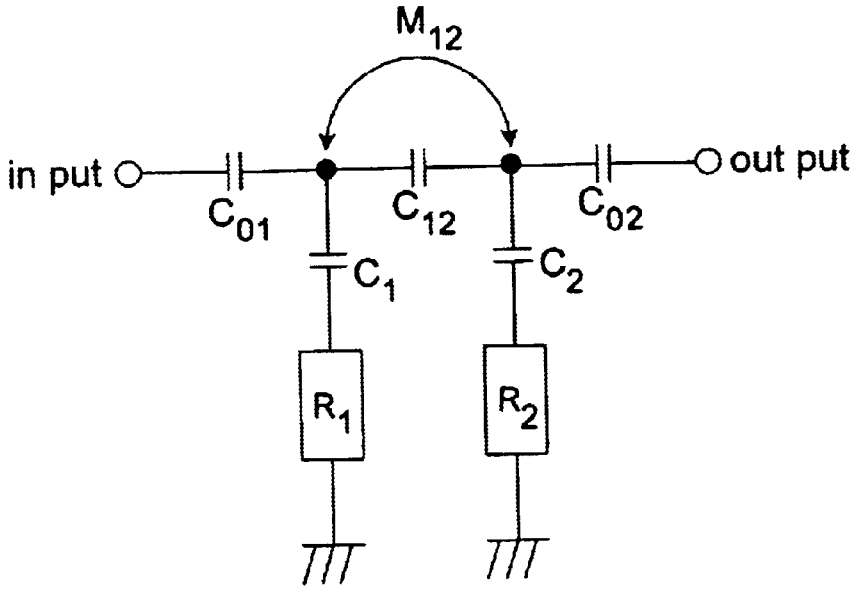
FIG. 5 is an equivalent circuit diagram of the integrated type dielectric filter of FIGS. 4A to 4F.

An equivalent circuit diagram of FIG. 5 is applied to all embodiments of FIGS. 4A to 4F, in the same manner. Accordingly, an explanation of the operation of the integrated type dielectric filter according to the one embodiment of the present invention will be discussed in detail accompanying FIGS. 4A and 5.

In FIG. 5, the reference numerals $R_1$ and $R_2$ each represent the resonator, and $C_{01}$ and $C_{02}$ each represent input/output terminal coupling capacitance which is formed between the first conductive patterns 117 and 118 and the input/output pads 110*a* and 110*b* of the dielectric block 101. Also, the reference numeral $C_{12}$ designates the coupling capacitance between the resonators $R_1$ and $R_2$, and $M_{12}$ designates the coupling inductance between the resonators $R_1$ and $R_2$. The coupling capacitance $C_{12}$ is formed between the first conductive patterns 117 and 118 on the first surface 120 of the dielectric block 101. In the equivalent circuit diagram under the above construction, if a signal is inputted to the input pad 110*a*, an electric field is formed in the two resonant holes 107 and 108 to operate the resonators $R_1$ and $R_2$. At this time, the coupling capacitance $C_{12}$ between the resonators $R_1$ and $R_2$ is increased by means of the second conductive pattern 125 on the first surface 120, and contrarily, the coupling inductance $M_{12}$ is decreased.

In other words, the coupling capacitance $C_{12}$ between the resonators $R_1$ and $R_2$ is greatly increased when compared with the case where the second conductive pattern 125 which is not formed on the first surface 120. The increment ratio of the coupling capacitance $C_{12}$ is adjustable in accordance with the length and width of the second conductive pattern 125. If the length and width of the second conductive pattern 125 is increased, the coupling capacitance $C_{12}$ is increased.

As shown in FIG. 5, the coupling capacitance $C_{12}$ and coupling inductance $M_{12}$ are formed between the resonant holes 107 and 108 by the second conductive pattern 125. Therefore, a maximum impedance value is formed on a resonant point caused by the coupling capacitance $C_{12}$ and coupling inductance $M_{12}$, such that a maximum attenuation point is generated at the resonant point.

Meanwhile, the resonant point is variable by the change of the value of the coupling capacitance $C_{12}$ or the coupling inductance $M_{12}$ or otherwise by he change of the two values. As discussed above, the values of the coupling capacitance $C_{12}$ and coupling inductance $M_{12}$ are changed in accordance with the variation of the length and the width of the second conductive pattern 125. As a result the attenuation point can be adjusted as the length and the width of the second conductive pattern 125 are varied.

Furthermore, since the coupling capacitance $C_{12}$ is greatly increased when compared with the case where the second conductive pattern 125 is not formed on the first surface 120, the attenuation point is positioned at a lower frequency band than a pass band as a reference band of the integrated type dielectric filter. Accordingly, the adjustment of the attenuation point is executed at the lower frequency band than the pass band by the second conductive pattern 125.

Figure 6:
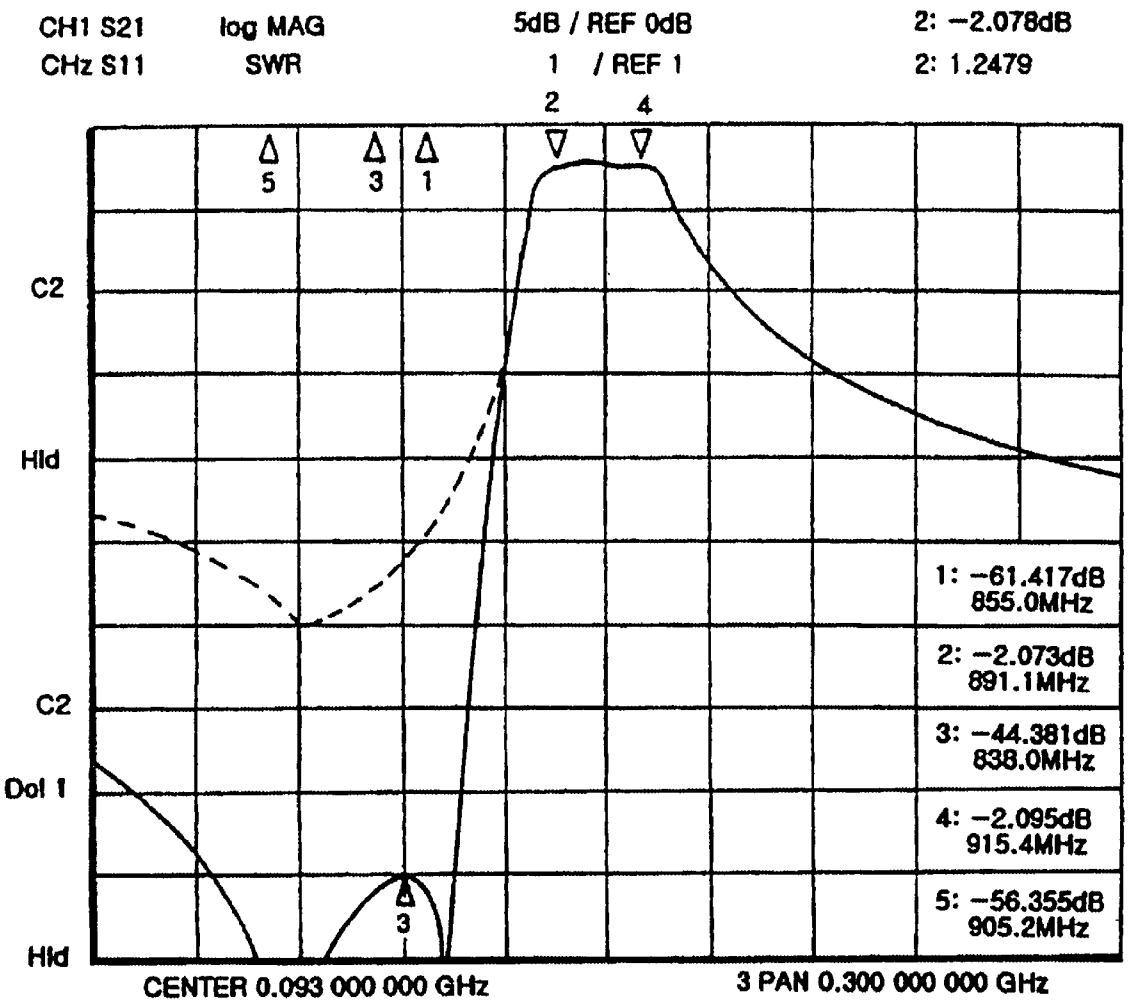
FIG. 6 is a graph illustrating characteristics compared between the conventional integrated type dielectric filter and the integrated type dielectric filter according to the present invention.

FIG. 6 is a graph illustrating characteristics compared between the conventional integrated type dielectric filter and the present integrated type dielectric filter. In this figure, the solid line indicates the characteristics curve of the present dielectric filter having the pass band of about 20 MHz at 896.1 MHz. In the curve, the gain for frequency is obtained in accordance with the adjustment of the length and the width of the second pattern 125. On the other hand, the dotted line shown in FIG. 6 indicates the characteristic of the conventional integrated type dielectric filter of which the first surface does not include the strip line pattern.

As shown, a degree of attenuation is similar between the present dielectric filter and the conventional dielectric filter at the higher frequency area than the pass band. However, it can be appreciated that the attenuation of about 20 dB or more in the present dielectric filter is generated at the lower frequency area than the pass band.

Figure 7:
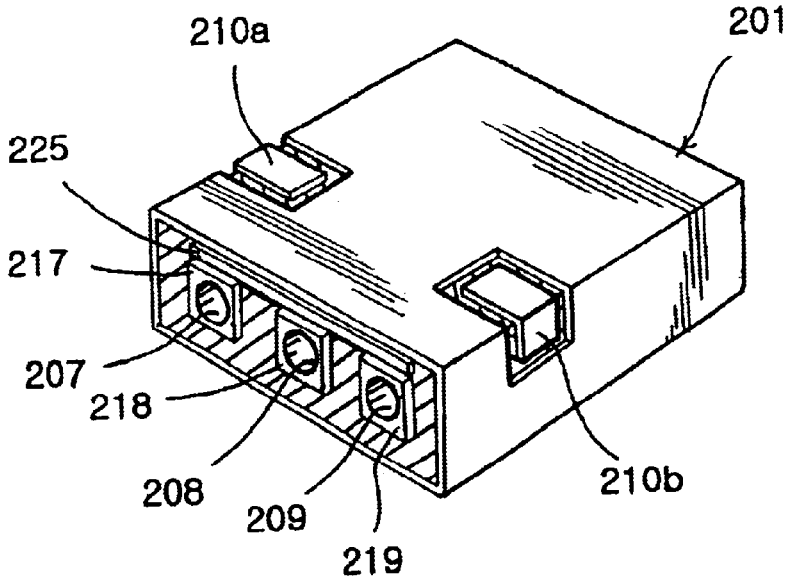
FIG. 7 is a perspective view of an integrated type dielectric filter according to other embodiment of the present invention.
Figure 8:
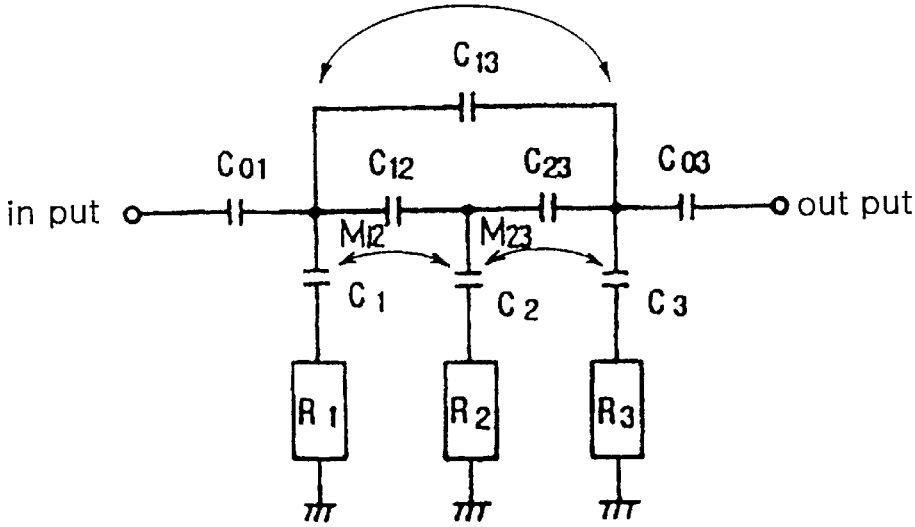
FIG. 8 is an equivalent circuit diagram of the integrated type dielectric filter of FIG. 7.

In the preferred embodiment of the present invention, the dielectric block has only the two resonant holes, but may have three or more resonant holes. Referring to FIG. 7 showing the integrated type dielectric filter according to the other embodiment of the present invention, a dielectric block 201 includes three resonant holes 207, 208 and 209. In this case, the dielectric block 201 includes a conductive pattern 225 which is disposed on the upper portions of the resonant holes 207, 208 and 209 along the arrangement direction of the resonant holes 207, 208 and 209. FIG. 8 is an equivalent circuit diagram of the integrated type dielectric filter of FIG. 7. As shown in figure, the conductive pattern 225 forms the coupling capacitance $C_{12}$ and $C_{23}$ between the adjacent resonators $R_1$ and $R_2$ and $R_2$ and $R_3$ and forms a cross coupling capacitance $C_{13}$ between the resonators $R_1$ and $R_3$ not adjacent to each other. In the same manner as the embodiment of FIGS. 4A to 4F, the preferred embodiment of FIG. 7 may include the conductive pattern 225 which is formed on arbitrarily selected position or has different shapes and further include another conductive patterns.

As discussed in the above, an integrated type dielectric filter according to the present invention can increase an attenuation ratio at the lower frequency area than a pass band to improve an attenuation ratio of a signal of an adjacent channel to the lower frequency area, adjust the physical length and the width of a predetermined strip line pattern to perform the adjustment of an attenuation point in a simple manner, and raise the attenuation ratio at a desired frequency band of the lower frequency area than the pass band.

Furthermore, an integrated type dielectric filter according to the present invention can conform to a recent trend that the interval between the adjacent channels is shortened, such that upon application to a radio communication device, it can increase an elimination ratio for the adjacent channel at the lower frequency area than a selected channel.

What is claimed is:

1. A dielectric filter comprising:

a dielectric block including first and second surfaces facing to each other and a side surface disposed between said first and second surfaces, said second and side surfaces being substantially covered with a conductive material;

a plurality of resonant holes extending between said first and second surfaces of said dielectric block in a substantially parallel manner and being substantially covered with said conductive material on the internal surfaces thereof to form resonator;

a first conductive pattern to form an electromagnetic coupling between said resonators;

input/output terminals for respectively receiving and transmitting signals from/to the outside, each of said input/output terminals including an electrode area isolated from said conductive material on the side surface of said dielectric block and for forming an electromagnetic coupling with a respective resonant holes; and at least one second conductive pattern disposed on said first surface of said dielectric block along an arrangement direction of said plurality of resonant holes and isolated from said input/output terminals, for strengthening a coupling capacitance between the adjacent resonators and forming a cross coupling capacitance between non-adjacent resonators.

2. The filter according to claim 1, wherein said second conductive pattern is is disposed above or below said resonant holes.

3. The filter according to claim 1, wherein said second conductive pattern is formed to be extended through at least two resonant holes.

4. The filter according to claim 3, wherein said second conductive pattern is formed to be extended to end portions of said at least two resonant holes.

5. The filter according to claim 1, wherein said first conductive pattern includes at least one conductive pattern formed on said first surface and surrounding a respective resonant hole and connected with said conductive material on the internal surface of said respective resonant hole, for applying a loading capacitance to the respective resonator and for forming an electromagnetic coupling between the adjacent resonators.

6. The filter according to claim 1, wherein said first conductive pattern having at least one conductive pattern which is disposed between end portions of said resonant holes at said first surface of said dielectric block, for forming said electromagnetic coupling between adjacent resonators.

7. The filter according to claim 6, wherein one end of said first conductive pattern is connected with said conductive material on the side surface of said dielectric block.

8. The filter according to claim 6, wherein both ends of said first conductive pattern are connected with said conductive material on the side surface of said dielectric block.

9. The filter according to claim 6, wherein said first conductive pattern includes at least two conductive patterns which are formed to be spaced at a predetermined distance relative to each other between the end portions of said resonant holes, and each being connected with said conductive material of said side surface of said dielectric block.

10. The filter according to claim 6, wherein said first conductive pattern is formed to be integrated with said second conductive pattern.

11. The filter according to claim 1, further comprising at least one third conductive pattern for adjusting a resonant frequency of said resonator and which is disposed on said first surface of said dielectric block.

12. The filter according to claim 11, wherein said third conductive pattern is formed to be extended from said conductive material on the side surface of said dielectric block toward the end portion of said resonant hole at said first surface.

13. The filter according to claim 11, wherein said third conductive pattern adjusts the resonant frequency by adjustment of an area thereof and a distance from the end portion of said resonant hole.

14. The filter according to claim 11, wherein said third conductive pattern is formed to be extended from said second conductive pattern toward the end portion of said resonant hole at said first surface.

15. The filter according to claim 11, wherein said third conductive pattern is formed to be extended from said second conductive pattern toward said side surface.

16. A dielectric filter comprising:

a dielectric block including first and second surfaces facing to each other and a side surface disposed between said first and second surfaces, said second and side surfaces being substantially covered with a conductive material;

a plurality of resonant holes extending between said first and second surfaces of said dielectric block in a substantially parallel manner and being substantially covered with said conductive material on the internal surfaces thereof to form resonators;

a first conductive pattern to form an electromagnetic coupling between said resonators;

input/output terminals for respectively receiving and transmitting signals from/to the outside, each of said input/output terminals having an electrode area isolated from said conductive material on the side surface of said dielectric block and for forming an electromagnetic coupling with a respective resonant hole; and at least one second conductive pattern disposed at a predetermined distance from the end portion of each of said plurality of resonant holes at said first surface of said dielectric block along an arrangement direction of said plurality of resonant holes and isolated from said input/output terminals, for strengthening a coupling capacitance between adjacent resonators and forming a cross coupling capacitance between non-adjacent resonators.

17. A dielectric filter comprising:

a dielectric block including first and second surfaces facing to each other and a side surface disposed between said first and second surfaces, said second and side surfaces being substantially covered with a conductive material;

a plurality of resonant holes extending between said first and second surfaces of said dielectric block in a substantially parallel manner and being substantially covered with said conductive material on the internal surfaces thereof to form resonators;

a first conductive pattern to form an electromagnetic coupling between said resonators;

input/output terminals for respectively receiving and transmitting signals from/to the outside, each of said input/output terminals including an electrode area isolated from said conductive material on the side surface of said dielectric block and for forming an electromagnetic coupling with a respective resonant hole;

at least one second conductive pattern disposed on said first surface of said dielectric block along with an arrangement direction of said plurality of resonant holes and isolated from said input/output terminals, for strengthening a coupling capacitance between the adjacent resonators and forming a cross coupling capacitance between non-adjacent resonators; and at least one third conductive pattern for adjusting a resonant frequency of said resonator and which is disposed on said first surface of said dielectric block.

18. The filter according to claim 17, wherein said third conductive pattern adjusts the resonant frequency by adjustment of an area thereof and a distance from the end portion of said resonant hole.

* * * * *